US009694830B2

(12) United States Patent
Kammler et al.

(10) Patent No.: US 9,694,830 B2
(45) Date of Patent: Jul. 4, 2017

(54) FASTENING ARRANGEMENT FOR CONNECTING AN EQUIPMENT CONTAINER TO A RAIL VEHICLE ROOF, AND RAIL VEHICLE EQUIPPED THEREWITH

(71) Applicant: SIEMENS AKTIENGESELLSCHAFT, Munich (DE)

(72) Inventors: Michael Kammler, Kempen (DE); Daniel Kroell, Moers (DE); Gerd Meyer, Leverkusen (DE); Klaus Stoll, Niederkruechten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/023,461

(22) PCT Filed: Aug. 29, 2014

(86) PCT No.: PCT/EP2014/068351

§ 371 (c)(1),
(2) Date: Mar. 21, 2016

(87) PCT Pub. No.: WO2015/039854

PCT Pub. Date: Mar. 26, 2015

(65) Prior Publication Data

US 2016/0207545 A1 Jul. 21, 2016

(30) Foreign Application Priority Data

Sep. 19, 2013 (DE) ..... 10 2013 218 772

(51) Int. Cl.
*B61D 1/00* (2006.01)
*B61D 17/12* (2006.01)

(52) U.S. Cl.
CPC ..... *B61D 17/12* (2013.01)

(58) Field of Classification Search
CPC ..... F61D 17/00; B61D 17/00
(Continued)

(56) References Cited

U.S. PATENT DOCUMENTS 1,116,037 A * 11/1914 Dufour ..... B61D 17/12 52/44
1,156,944 A * 10/1915 Thompson et al. ... B61D 17/12 52/48

(Continued)

FOREIGN PATENT DOCUMENTS

DE 102009031599 A1 1/2011
DE 102011081229 A1 2/2013

(Continued)

*Primary Examiner* — Adriana Figueroa
*Assistant Examiner* — Jessie Fonseca
(74) *Attorney, Agent, or Firm* — Laurence Greenberg; Werner Stemer; Ralph Locher

(57) ABSTRACT

A fastening configuration for connecting a roof-side equipment container to the roof of a rail vehicle includes a fastening rail and a clamping device which engages in the fastening rail in order to clamp a retention section of the equipment container. The fastening rail is constructed as a T-rail which has a web associated with the roof and a support plate at the end of the web which runs perpendicular to the web and which is associated with the retention section of the equipment container. The T-rail has a hole which extends through the support plate into the web, and the clamping device can be inserted in the hole and engages under the support plate.

11 Claims, 3 Drawing Sheets

(58) Field of Classification Search
USPC ..... 52/45, 47, 48, 51, 54
See application file for complete search history.

(56) References Cited

U.S. PATENT DOCUMENTS

| | | | | | |
|---|---|---|---|---|---|
| 1,296,308 | A * | 3/1919 | Murphy | B61D 17/12 | 52/49 |
| 1,821,904 | A * | 9/1931 | Bonsall | B61D 17/12 | 52/49 |
| 1,952,123 | A * | 3/1934 | Ditchfield | B61D 17/043 | 52/51 |
| 2,011,628 | A * | 8/1935 | Gregg | B61D 17/12 | 105/409 |
| 5,014,934 | A * | 5/1991 | McClaflin | B64C 1/12 | 244/129.4 |
| 2012/0102846 | A1 | 5/2012 | Assel | | |

FOREIGN PATENT DOCUMENTS

| | | | | | |
|---|---|---|---|---|---|
| EP | 2505449 | A1 | 10/2012 | | |
| JP | WO 2012137706 | A1 * | 10/2012 | B61D 17/12 | |

* cited by examiner

FASTENING ARRANGEMENT FOR CONNECTING AN EQUIPMENT CONTAINER TO A RAIL VEHICLE ROOF, AND RAIL VEHICLE EQUIPPED THEREWITH

BACKGROUND OF THE INVENTION

Field of the Invention

Fastening arrangement for connecting an equipment container to a rail vehicle roof, and rail vehicle equipped therewith The invention relates to a fastening arrangement for connecting a roof-side equipment container to the roof of a rail vehicle, having a fastening rail and a clamping device which in order to clamp a retention portion of the equipment container engages in the fastening rail, and a rail vehicle which is provided therewith.

It is, for example, known from the vehicles of the "AM08" series of the Belgian State Railways to jointly press, on the roof of a passenger train with an integral aluminum construction, a heavy-duty rail in the form of a closed C-rail with the roof profile-member, wherein the C-rail can be used as a connection location for roof components/equipment containers.

The C-rail which is used is primed and painted from the outer side prior to final assembly, but with internal surfaces as a result of the structural shape of the C-rail not being painted in accordance with quality standards or not being painted at all and therefore being more susceptible to corrosion than surfaces which are painted in accordance with provisions. A connection of the equipment containers and the C-rail is achieved by means of a hole in the C-rail and a screw connection which is inserted therein. In this instance, a steel sliding block is placed inside the C-rail and a roof container connection of steel is placed on the C-rail. In addition to the holes in the C-rail, cut-outs are incorporated at specific locations of the C-rail so that drainage of the roof is ensured.

A disadvantage of this procedure is that, in the selected arrangement, steel is positioned directly on unprotected aluminum and as a result of moisture (water) electrochemical corrosion occurs. Since aluminum is less noble than steel, the aluminum corrodes. A repair is in this instance only possible with difficulty so that, after an uncertain time, the heavy-duty C-rail fails. Since the C-rail is also pressed on the roof profile-member, the C-rail cannot readily be replaced.

BRIEF SUMMARY OF THE INVENTION

Based on this, an object of the invention is to develop the fastening arrangement mentioned in the introduction in such a manner that the connection structure which is produced is better protected against corrosion.

This object is achieved with the fastening arrangement mentioned in the introduction in that the fastening rail is constructed as a T-rail which has a web which is associated with the roof and a support plate which extends at the end of the web perpendicularly to the web and which is associated with the retention portion of the equipment container, wherein the T-rail has a hole which extends through the support plate into the web and the clamping device can be inserted into the hole and engages below the support plate.

The use of the T-rail with a hole in place of the C-rail has the advantage that in particular the support plate is accessible in the region of the hole from both sides. It is thereby possible to prime and paint all surfaces which moisture can reach in accordance with the quality standard. In this manner, a substantially improved corrosion protection is produced with respect to the C-rail. Drainage is also readily ensured.

Preferably, the clamping device may have a bush which is positioned on the support plate and which extends as far as a lower side of the support plate and which cooperates with a plate-like counter-bearing which is in abutment with a lower side of the support plate in the transverse direction of the web, wherein the bush at the upper side thereof in a radial direction is graduated in such a manner that the retention portion of the equipment container can be placed on the upper side of the bush. In this manner, an advantageous arrangement of the retention portion of the equipment container is produced.

There may be provided a clamping screw which extends through the bush and which can be screwed into an axial thread of the counter-bearing. A secure clamping of the retention portion of the equipment container is consequently produced.

It is obvious for the person skilled in the art that the thread in which the clamping screw can be screwed does not necessarily have to be provided on the counter-bearing. Alternatively, it is also possible for the counter-bearing to have only one hole and for the clamping screw to be secured with a nut at sides of the counter-bearing. However, this embodiment is less space-saving than the one described above.

The retention portion of the equipment container can be clamped between the upper side of the bush and a washer which is arranged between the retention portion of the equipment container and a head of the clamping screw. In this manner, the retention portion of the equipment container is fixed in a reliable manner on an upper side of the T-rail.

Preferably, the bush can be constructed as a rubber/metal element, wherein a rubber portion of the bush extends at least in the transverse direction of the web along an abutment face with the support plate of the T-profile. This has the advantage, when the bush is produced, for example, from the material steel, of preventing direct contact with the T-rail which, in rail vehicles with an integral aluminum construction, will also comprise aluminum. A possible risk of corrosion is thereby prevented.

For the same reasons, the counter-bearing may be constructed as a rubber/metal element, wherein a rubber portion of the counter-bearing then extends in a transverse direction of the web along a support face with the support plate of the T-profile.

If both the bush and the counter-bearing are constructed as rubber/metal elements of the type described above, the clamping device to which the bush and the counter-bearing belong may be produced from steel. This is often the case since housings of equipment containers and consequently also the retention portions thereof generally comprise steel. Furthermore, the configurations of the counter-bearing and the bush as rubber/metal elements afford the advantage that, with regard to an assembly of the equipment container and temperature-related length changes, a tolerance compensation is enabled.

In order to also achieve advantageous accessibility to the inner faces of the T-rail hole, it is advantageous for the hole in the T-rail to extend into the web over up to at least half the height of the web. Taking into account strength requirements, the hole may also extend to a deeper extent into the web.

The above-mentioned object is achieved with regard to the rail vehicle by a rail vehicle having a fastening arrangement in the above-described embodiments. In this manner, roof equipment containers, as long as they have appropriately shaped retention portions, can be fitted to the roof of the rail vehicle using the fastening arrangement.

In this instance, it is preferable for the T-rail to already be pressed with an extruded aluminum profile-member for the roof during production of the shell of the rail vehicle.

BRIEF DESCRIPTION OF THE SEVERAL VIEWS OF THE DRAWING

An embodiment of the invention will be described in greater detail below with reference to the drawings, in which.

DESCRIPTION OF THE INVENTION

Figure 1:
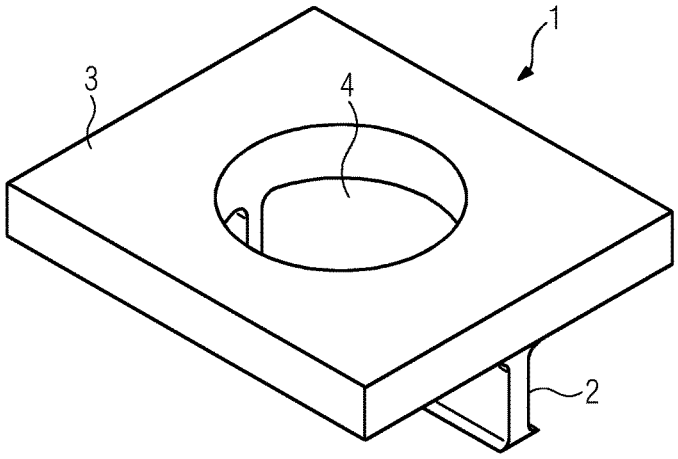
FIG. 1 is a perspective view of a T-rail.
Figure 2:
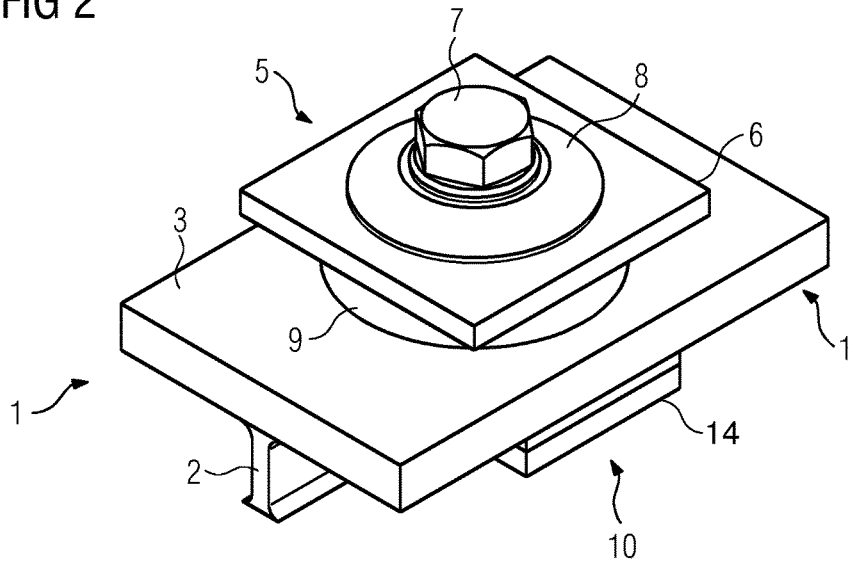
FIG. 2 is a perspective view of the T-rail of FIG. 1 in combination with a clamping device.

FIG. 1 shows a heavy-duty T-rail 1 which is part of a fastening arrangement for an equipment container which is intended to be fitted to the roof of a rail vehicle. Such equipment containers may, for example, contain an air-conditioning system or a brake resistor.

The T-rail 1 has a web 2 which in the assembled state of the T-rail extends vertically and is connected with the free end thereof to a profile-member of the roof of the rail vehicle. In particular, the T-rail 1 can already be pressed by means of the web 2 when, for example, an extruded aluminum profile-member is produced for the roof of the rail vehicle.

In addition to the web 2, the T-rail 1 has a support plate 3 which forms a structural unit with the web 2. The support plate 3 has a hole 4 which extends completely through the support plate 3 and into the web 2 over a distance which is greater than half the height of the web 2. Consequently, the T-rail 1 can be protected against corrosion not only from the outer side, but also on the inner faces of the hole 4 using conventional methods, for example, by applying an appropriate layer of paint, with priming beforehand.

In the embodiment illustrated, the T-rail is produced from aluminum and provided for use in a rail vehicle which is produced with an integral aluminum construction.

However, a clamping device 5 which in the fastening arrangement cooperates with the T-rail in order to fasten a retention portion 6 of an equipment container (not illustrated) primarily comprises steel.

A clamping screw 7 which clamps the retention portion 6 with a washer 8 being interposed belongs to the clamping device 5. As can be seen from FIG. 3, the retention portion 6 is in this instance retained by means of a bush 9 with spacing from the upper side of the support plate 3. The clamping screw 7 is screwed into an axial thread of a counter-bearing 10.

Figure 3:
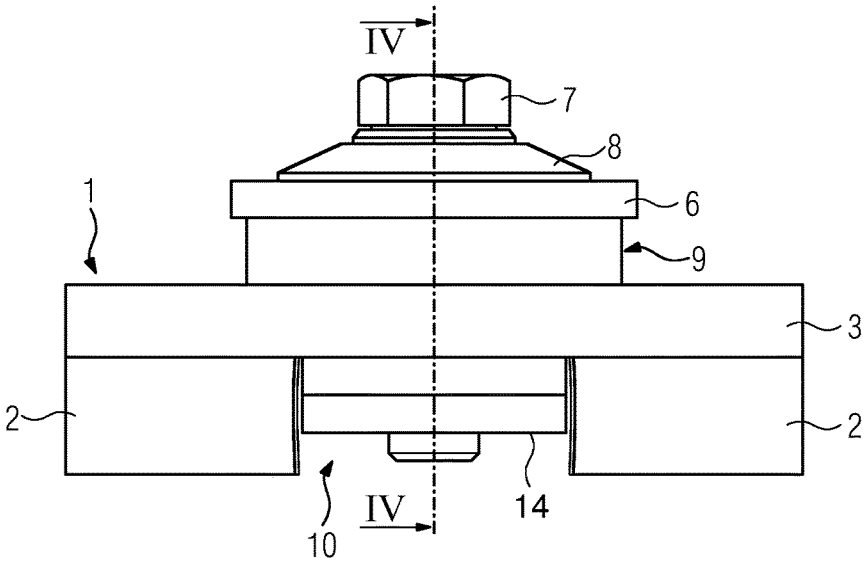
FIG. 3 is a side view of the combination of T-rail and clamping device of FIG. 2.

FIG. 3 shows the securing arrangement from the side. In the region of the hole 4, there is provided below the support plate 3 a plate-like counter-bearing 10 which extends in the direction of the web 2 over the diameter of the hole 4. In contrast, the bush 9 above the support plate 3 has a larger diameter than the hole 4 so that the bush 9 is positioned in this region on the support plate 3.

Figure 4:
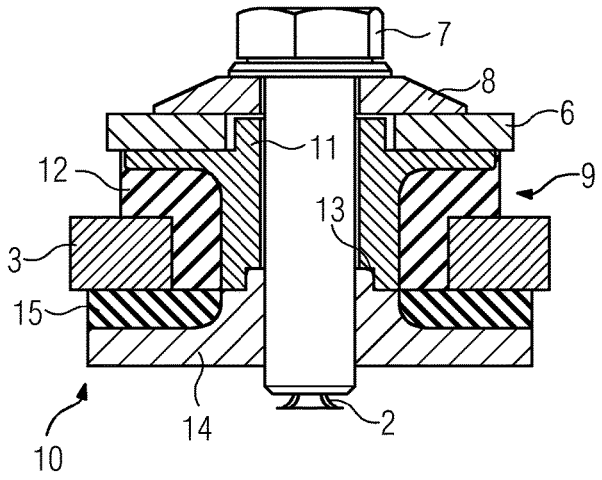
FIG. 4 is a cross-section view of the combination of T-rail and clamping device according to FIGS. 2 and 3, along a line IV, IV of FIG. 3.

As can be seen from FIG. 4, the bush 9 is constructed as a rubber/metal element. At the upper side thereof, it has in a radial direction a graduation so that the retention portion 6 which is provided with an opening can move into abutment with the bush 9. In this instance, the height of the step is slightly smaller than the thickness of the retention portion 6. Whilst the portion of the bush 9 which extends around the clamping screw 7 and the portion which is located below the retention portion 6 are produced from steel and form an inner bush portion 11, the outer periphery of the bush portion 11 is adjoined by a rubber element 12 which extends along the support faces of the bush 9 with the support plate 3 and also surrounds the portion of the bush 9 which forms the support face for the retention element 6. Consequently, the outer face of the rubber element 12 extends from the upper side of the support plate 3 as far as the lower side of the retention element 6. On the whole, the bush 9 terminates with the lower side thereof with the lower side of the support plate 3. The bush 9 is generally constructed in a cylinder-symmetrical manner and inserted into the hole 4.

At a lower side of the support plate 3 there is arranged the counter-bearing 10 which is also in the form of a rubber/metal element. An inner counter-bearing portion 14 which is associated with the clamping screw 7 is produced from steel and engages in the bush from below in an annular recess 13 at the inner side of the bush 9 so that the counter-bearing 10 is centered with the bush 9. A portion 15 of the counter-bearing 10 facing the support plate 3 is produced from rubber and extends along an abutment face of the counter-bearing 10 with the support plate 3 and further inwards from an inner edge of the support plate 3 so that the portion 15 is connected to the rubber element 12 in such a manner that these two rubber elements 12, 15 engage round the support plate 3 and seal both the inner bush portion 11 and the inner counter-bearing portion 14 which comprise steel with respect to the support plate 3 of aluminum so that corrosion is prevented.

Figure 5:
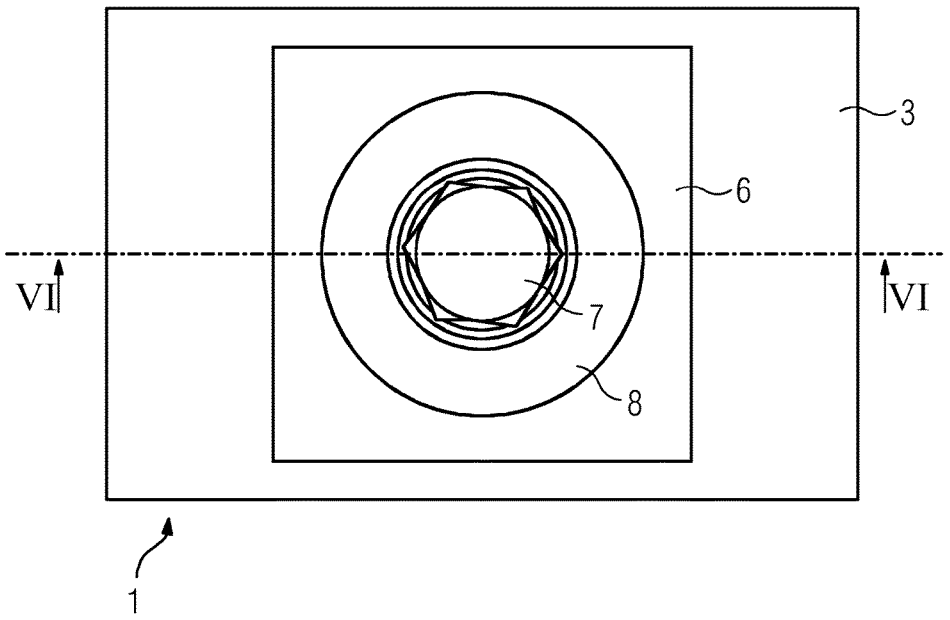
FIG. 5 is a plan view of the combination of the T-rail and clamping device of FIG. 2.

From FIG. 5, it can be seen that the longitudinal extent of the T-rail 1 corresponds to at least three times the diameter of the hole 4. This ensures adequate introduction of force from the equipment container via the retention portion and the fastening arrangement into the roof profile-member and primarily over the remaining length portions of the web 2 over the full height, that is to say, outside the hole 4.

Figure 6:
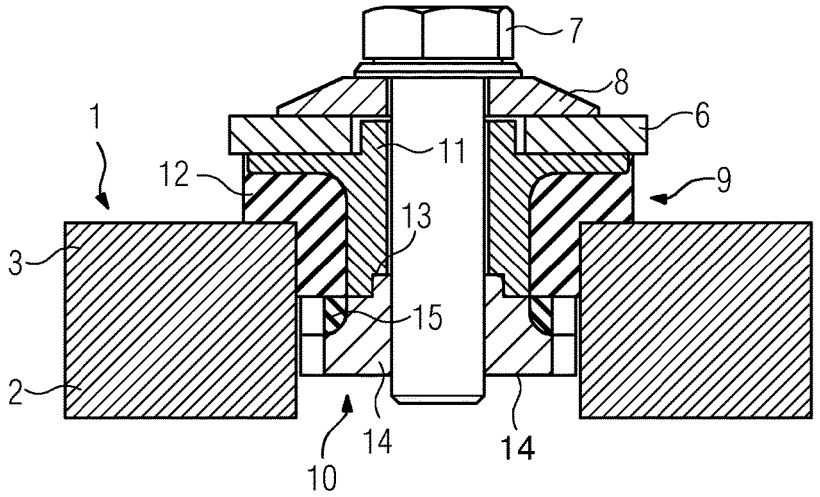
FIG. 6 is a cross-section of the combination of the T-rail and clamping device of FIGS. 2-5 along a line VI, VI of FIG. 5.

From FIG. 6, it can be seen that the counter-bearing 10 maintains a spacing with respect to the web 2 in the region of the hole 4 and consequently extends in the direction of the web 2 to a lesser extent than in the transverse direction with respect to the web 2. The counter-bearing 10 additionally has a suitable thread in which the clamping screw 7 can be screwed, whereby the retention portion 6 is clamped and consequently fixed.

The invention claimed is:

1. A fastening configuration for connecting a roof-side equipment container to a roof of a rail vehicle, the fastening configuration comprising:

a fastening rail constructed as a T-rail, said T-rail having a web associated with the roof of the rail vehicle, said T-rail having a support plate extending at an end of said web perpendicularly to said web and being associated with a retention portion of the equipment container, said web having a height perpendicular to said support plate and a thickness parallel to said support plate, said T-rail having a hole extending through said support plate into said web, said hole being parallel to said height and spanning an entirety of said thickness; and a clamping device engaging in said T-rail for clamping the retention portion of the equipment container, said clamping device being insertable into said hole and engaging below said support plate.

2. The fastening configuration according to claim 1, wherein:

said support plate has a lower side;

said clamping device has a bush being positioned on said support plate and extending as far as said lower side of said support plate;

a counter-bearing cooperating with said bush and being in abutment with said lower side of said support plate in a direction transverse to said web; and said bush having an upper side being graduated in a radial direction permitting the retention portion of the equipment container to be placed on said upper side of said bush.

3. The fastening configuration according to claim 2, wherein said bush is constructed as a rubber and metal element having a rubber portion extending along an abutment face with said support plate of said T-rail.

4. The fastening configuration according to claim 2, wherein said counter-bearing is constructed as a rubber and metal element having a rubber portion extending in a direction transverse to said web along a support face with said support plate of said T-rail.

5. The fastening configuration according to claim 2, which further comprises a clamping screw extending through said bush and configured to be screwed into an axial thread of said counter-bearing.

6. The fastening configuration according to claim 5, which further comprises a washer disposed between the retention portion of the equipment container and a head of said clamping screw, the retention portion of the equipment container being clamped between said upper side of said bush and said washer.

7. The fastening configuration according to claim 1, wherein said hole in said T-rail extends into said web over a distance equal to up to at least half of a height of said web.

8. The fastening configuration according to claim 1, wherein:

said support plate has a lower side;

said clamping device has a bush disposed in said hole and being positioned on said support plate and extending as far as said lower side of said support plate;

a counter-bearing cooperating with said bush and being in abutment with said lower side of said support plate in a direction transverse to said web; and said bush having an upper side being graduated in a radial direction permitting the retention portion of the equipment container to be placed on said upper side of said bush.

9. The fastening configuration according to claim 1, wherein said hole in said T-rail extends into said web over at least half of a height of said web.

10. A rail vehicle, comprising a fastening configuration according to claim 1.

11. A fastening configuration for connecting a roof-side equipment container to a roof of a rail vehicle, the fastening configuration comprising:

a fastening rail constructed as a T-rail, said T-rail having a substantially straight web associated with the roof of the rail vehicle, said web having a height between an attachment end and a second end of said web, said T-rail having a support plate extending at said attachment end of said web above and perpendicularly to said height and being associated with a retention portion of the equipment container, said T-rail having a hole extending through said support plate into said web through said attachment end; and a clamping device engaging in said T-rail for clamping the retention portion of the equipment container, said clamping device being insertable into said hole and engaging below said support plate.

* * * * *